US009796176B2

(12) United States Patent
Satoh

(10) Patent No.: US 9,796,176 B2
(45) Date of Patent: Oct. 24, 2017

(54) IMAGE FORMING APPARATUS, METHOD OF FORMING IMAGE, AND NON-TRANSITORY RECORDING MEDIUM

(71) Applicant: Taku Satoh, Kanagawa (JP)

(72) Inventor: Taku Satoh, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/372,827

(22) Filed: Dec. 8, 2016

(65) Prior Publication Data

US 2017/0165958 A1 Jun. 15, 2017

(30) Foreign Application Priority Data

Dec. 10, 2015 (JP) ..... 2015-241255
Nov. 15, 2016 (JP) ..... 2016-222071

(51) Int. Cl.
*B41J 29/38* (2006.01)
*B41J 29/393* (2006.01)
*B41J 2/045* (2006.01)

(52) U.S. Cl.
CPC ..... *B41J 2/0456* (2013.01); *B41J 2/04586* (2013.01)

(58) Field of Classification Search
CPC .... B41J 2/0456; B41J 2/04586; B41J 2/2121; B41J 3/543; B41J 2/04581; B41J 2/0451; B41J 2/04561; B41J 2/16579; B41J 2/16588; B41J 2202/21
USPC ..... 347/5, 9, 14, 19
See application file for complete search history.

(56) References Cited

U.S. PATENT DOCUMENTS 8,905,512 B2 * 12/2014 Satoh ..... B41J 2/12 347/15
9,016,819 B2 * 4/2015 Ono ..... B41J 2/0451 347/14
2008/0117467 A1 5/2008 Hosaka et al.
2008/0137147 A1 6/2008 Nakano et al.
2010/0182367 A1 7/2010 Takagi et al.
(Continued)

FOREIGN PATENT DOCUMENTS

JP 2002-086767 3/2002
JP 2003-063043 3/2003
(Continued)

*Primary Examiner* — An Do
(74) *Attorney, Agent, or Firm* — Harness, Dickey & Pierce, P.L.C.

(57) ABSTRACT

An image forming apparatus includes a first recording head including nozzles, each nozzle discharging liquid droplets, a second recording head including nozzles, each nozzle discharging liquid droplets, a detector to detect whether there is a non-discharging nozzle among the nozzles of the first recording head and the second recording head, the non-discharging nozzle being incapable of discharging the liquid droplets, and a controller to control at least one of the amount of the liquid droplet discharged from an adjacent nozzle to the non-discharging nozzle of the first recording head and the amount of the liquid droplet discharged from an adjacent nozzle to the non-discharging nozzle of the second recording head when the target landing position of the liquid droplet of the non-discharging nozzle of the first recording head is the same as the target landing position of the liquid droplet of the non-discharging nozzle of the second recording head.

6 Claims, 15 Drawing Sheets

(56) References Cited

U.S. PATENT DOCUMENTS

| | | | |
|---|---|---|---|
| 2011/0090276 | A1 | 4/2011 | Hirano |
| 2012/0223989 | A1 | 9/2012 | Takagi et al. |
| 2012/0223991 | A1 | 9/2012 | Ono |
| 2014/0043391 | A1 | 2/2014 | Satoh et al. |
| 2017/0129238 | A1* | 5/2017 | Kuwayama ..... B41J 2/04573 |

FOREIGN PATENT DOCUMENTS

| | | |
|---|---|---|
| JP | 2010-017918 | 1/2010 |
| JP | 2012-183654 | 9/2012 |
| JP | 2013-237167 | 11/2013 |
| JP | 2014-188784 | 10/2014 |
| JP | 2014-188785 | 10/2014 |

* cited by examiner

FIG. 9
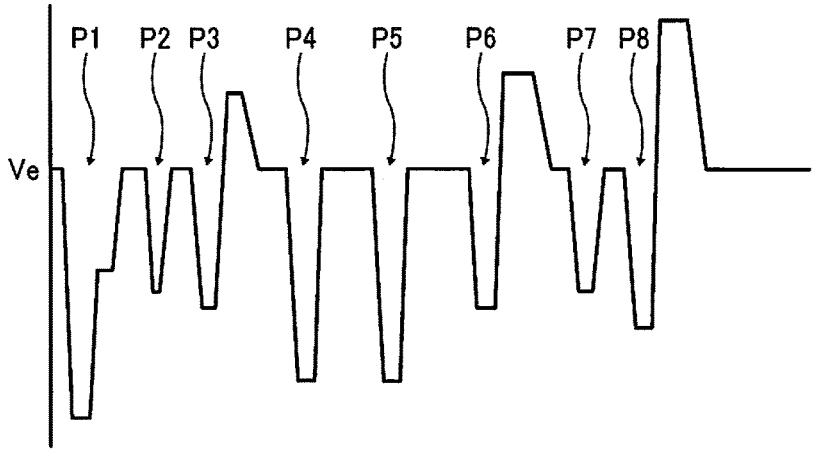
FIG. 10(A) SMALL DROPLET
FIG. 10(B) MIDDLE-SIZED DROPLET
FIG. 10(C) LARGE DROPLET
FIG. 10(D) FINE DRIVE
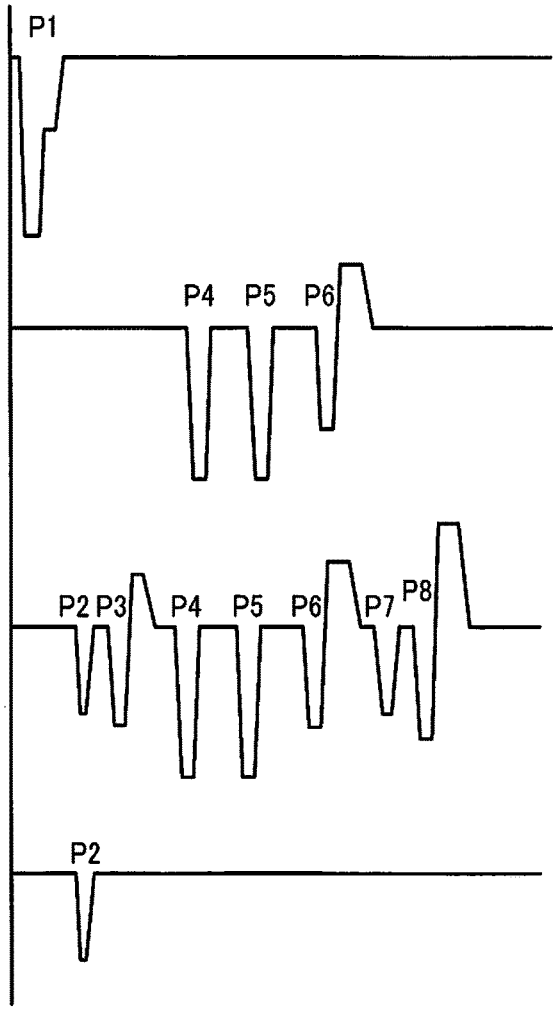

: NORMAL NOZZLE

: NON-DISCHARGING NOZZLE

NO NON-DISCHARGING NOZZLE CORRECTION

MODULATION OF DOT SIZE OF ADJACENT DOT

CYAN

MAGENTA

CYAN + MAGENTA

IMAGE FORMING APPARATUS, METHOD OF FORMING IMAGE, AND NON-TRANSITORY RECORDING MEDIUM

CROSS-REFERENCE TO RELATED APPLICATIONS

This patent application is based on and claims priority pursuant to 35 U.S.C. §119 to Japanese Patent Application Nos. 2015-241255 and 2016-222071, filed on Dec. 10, 2015, and Nov. 15, 2016, respectively, in the Japan Patent Office, the entire disclosures of which are hereby incorporated by reference herein.

BACKGROUND

Technical Field

The present invention relates to an image forming apparatus, a method of forming an image, and a non-transitory recording medium.

Description of the Related Art

Inkjet line printers capable of printing images with high performance have been introduced into the market to satisfy the demand for improvement on productivity. In addition, printers having higher recording density have been introduced to meet the demand for higher quality year by year.

For this reason, inkjet printers have been diffusing on the market. Accordingly, those inkjet printers have been used for various purposes, which leads to an increase of variety of recording media.

Regarding inkjet recording devices, if a defective (non-discharging) ink nozzle is detected, a technology is known to increase the amount of liquid droplets from an adjacent nozzle to suppress the occurrence of white streaks.

However, when discharging failure occurs to the same site in different recording heads, the amount of liquid droplets are similarly increased. This causes ink overflow, which leads to degradation of image quality.

SUMMARY

According to the present invention, provided is an improved image forming apparatus including a first recording head including nozzles, each nozzle discharging liquid droplets, a second recording head including nozzles, each nozzle discharging liquid droplets, a detector to detect whether there is a non-discharging nozzle among the nozzles of the first recording head and the nozzles of the second recording head, the non-discharging nozzle being incapable of discharging the liquid droplets, and a controller to control at least one of the amount of the liquid droplet discharged from an adjacent nozzle to the non-discharging nozzle of the first recording head and the amount of the liquid droplet discharged from an adjacent nozzle to the non-discharging nozzle of the second recording head when the target landing position of the liquid droplet of the non-discharging nozzle of the first recording head is the same as the target landing position of the liquid droplet of the non-discharging nozzle of the second recording head.

BRIEF DESCRIPTION OF THE SEVERAL VIEWS OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein:

FIG. 9 is a diagram illustrating an example of the drive waveform generated and output at the drive waveform generating unit of the print controller of the image forming apparatus illustrated in FIG. 1;

FIG. 10(A) is a diagram illustrating a small droplet selected from the a drive waveform, FIG. 10(B) is a diagram illustrating a middle-sized droplet selected from a drive waveform, FIG. 10(C) is a diagram illustrating a large droplet selected from a drive waveform, and FIG. 10(D) is a diagram illustrating a fine drive selected from the a drive waveform;

DESCRIPTION OF THE EMBODIMENTS

Figure 1:
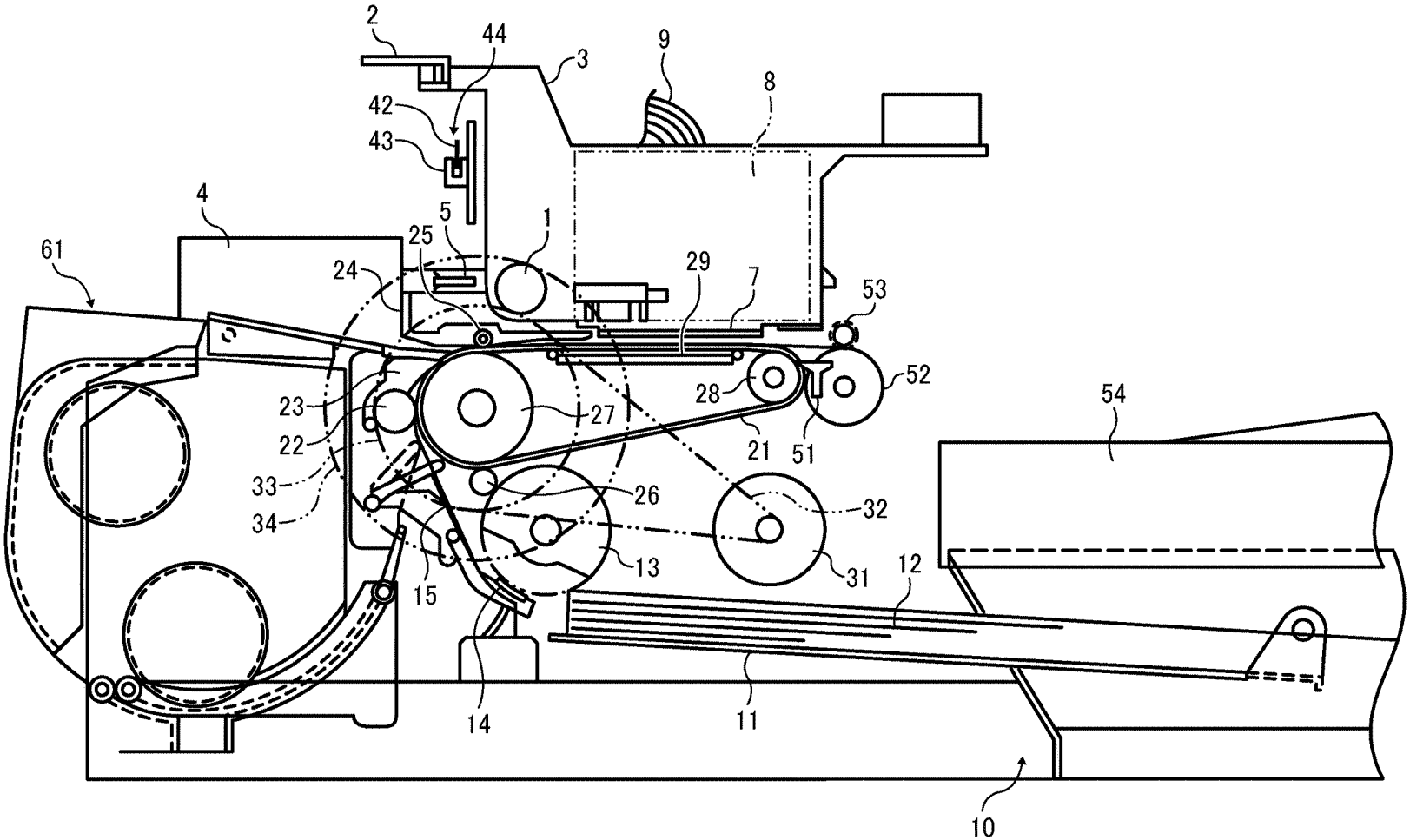
FIG. 1 is a diagram illustrating a side view of the entire configuration of the mechanism according to an embodiment of the image forming apparatus of the present disclosure.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

As used herein, the singular forms "a", "an", and "the" are intended to include the plural forms as well, unless the context clearly indicates otherwise.

Moreover, image forming, recording, printing, modeling, etc. in the present disclosure represent the same meaning.

EMBODIMENTS

Figure 2:
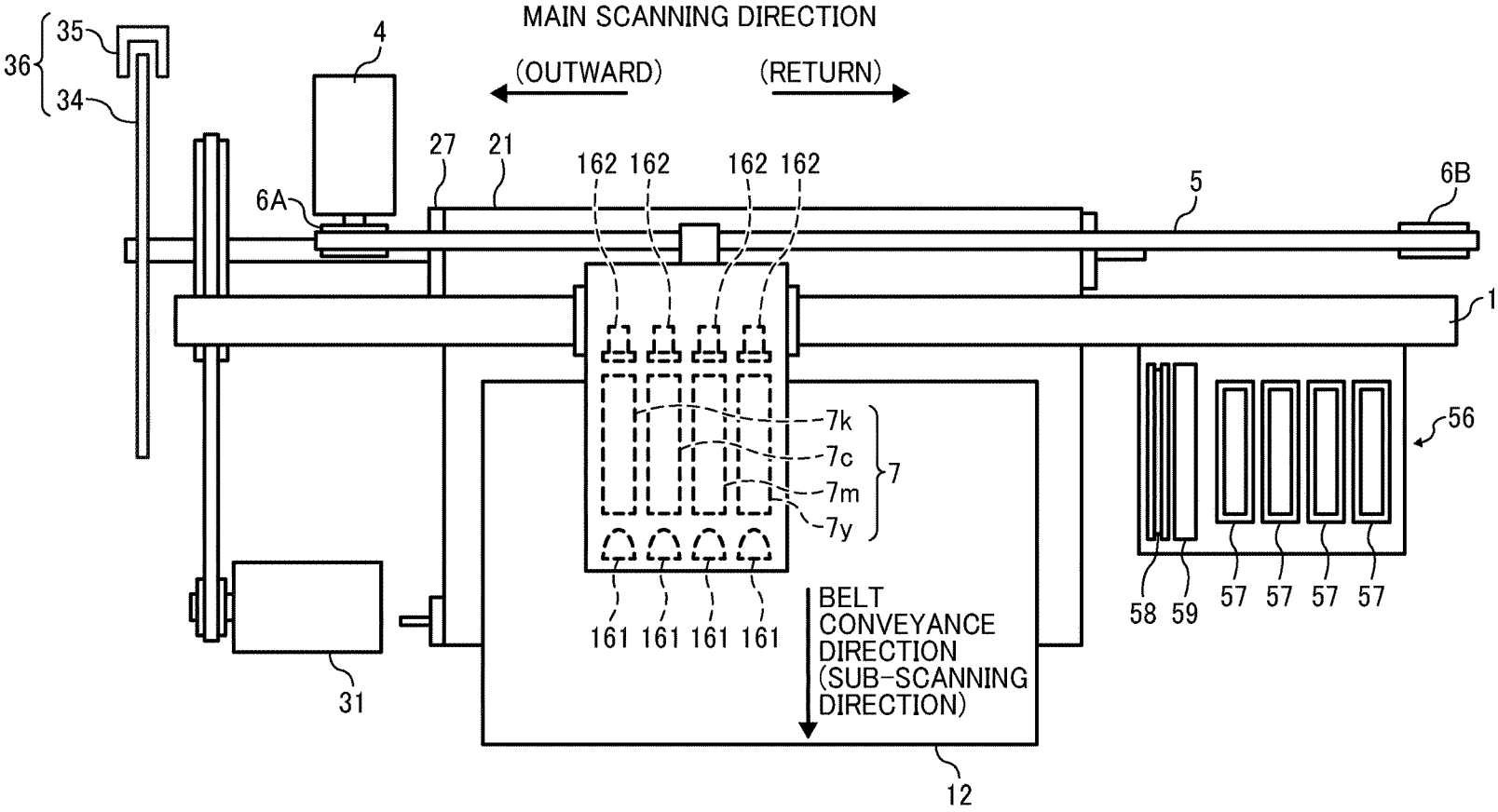
FIG. 2 is a diagram illustrating a plane view of the mechanism of the image forming apparatus illustrated in FIG. 1.

Embodiments of the present disclosure are described with reference to the accompanying drawings. The image forming apparatus that outputs image data generated according to the image forming method relating to the present disclosure is described using an example with reference to FIG. 1 and FIG. 2. FIG. 1 is a diagram illustrating a side view of the entire configuration of the mechanism according to an embodiment of the image forming apparatus of the present disclosure. FIG. 2 is a diagram illustrating a plane view of the mechanism of the image forming apparatus illustrated in FIG. 1.

The image forming apparatus includes a guiding rod 1 and a guiding rail 2 laterally bridged to side plates on the right and left sides which slidably hold a carriage 3 in the main scanning direction. A main scanning motor 4 moves and scans the carriage 3 in the direction (main scanning direction) indicated by arrows in FIG. 2 via a timing belt 5 stretched between a drive pully 6A and a driven pully 6B.

The carriage 3 includes, for example, four recording head units 7*y*, 7*c*, 7*m*, and 7*k* including liquid discharging heads to discharge yellow (Y), cyan (C), magenta (M), and black (K) liquid. The four recording head units 7*y*, 7*c*, 7*m*, and 7*k* are disposed in such a manner that multiple ink discharging orifices are aligned in the direction crossing the main scanning direction with the ink droplet discharging direction downward. Each of the recording head units 7*y*, 7*c*, 7*m*, and 7*k* is referred to as the recording head 7 when it is not necessary to distinguish the color.

In some embodiments, four color inks are carried but other color inks can be carried as well. Moreover, processing fluid to improve fixability and gloss imparting fluid to impart gloss can be carried.

As the liquid discharging head constituting the recording head 7, for example, it is possible to use a piezoelectric actuator such as a piezoelectric element and a thermal actuator that utilizes the phase change caused by film boiling of a liquid by using an electric heat conversion element such as a heat element. In addition, it is possible to use a shape-memory alloy actuator that uses the metal phase change due to the temperature change and an electrostatic actuator that uses an electrostatic force as a pressure generating device to generate a pressure to discharge liquid droplets.

In addition, a single or multiple liquid discharging heads, each having a nozzle line constituted of multiple nozzles to discharge liquid droplets of multiple colors, can be used as well as the head configuration including independent heads for individual colors. In some embodiments, a serial type printer is taken as an example as illustrated in FIG. 2. Also, the configuration illustrated in FIG. 3 is suitable.

Figure 3:
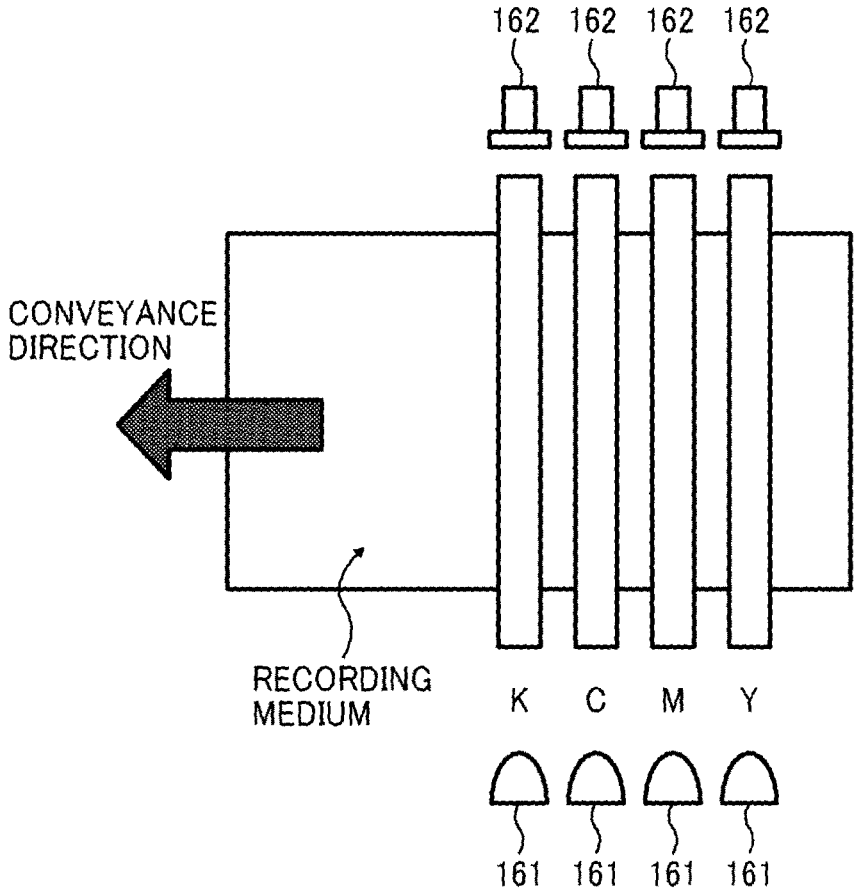
FIG. 3 is a conceptual diagram illustrating a line printer including heads for colors covering the width of paper.

FIG. 3 is a conceptual diagram illustrating a line printer including heads for each color covering the width of paper.

The carriage 3 illustrated in FIG. 2 carries a sub-tank 8 for each color to supply ink of each color to the recording head 7. The ink is supplied and replenished to the sub-tank 8 from a main tank (ink cartridge) via an ink supplying tube 9.

A sheet feeding unit to feed a sheet 12 loaded on a sheet loading unit (pressure plate) 11 such as a sheet feeder cassette 10 includes a separation pad 14 made of a material having a large friction index while facing a half-moon shape roller (sheet feeding roller) 13 to separate and feed the sheet 12 one by one from the sheet loading unit 11. The separation pad 14 is biased to the half-moon shape roller 13.

A conveyor belt 21 electrostatically adsorbs the sheet 12 fed from the sheet feeding unit and conveys the sheet 12 below the recording head 7. A counter roller 22 pinches the sheet 12 conveyed from the sheet feeding unit via a guide 15 with a conveyor belt 21 to convey the sheet 12. A conveyor guide 23 conveys the sheet 12 approximately 90 degrees upward for the sheet 12 to trace the conveyor belt 21. A pressing roller 25 is biased towards the conveyor belt 21 by a pressing member 24. In addition, a charging roller 26 serving as a charger is disposed to charge the surface of the conveyor belt 21.

The conveyor belt 21 takes an endless form, stretched between a conveyor roller 27 and a tension roller 28. A sub-scanning motor 31 rotates the conveyor roller 27 via a timing belt 32 and a timing roller 33. Due to this rotation, the conveyor belt 21 is circulated in the belt conveying direction (sub-scanning direction) as illustrated in FIG. 2.

On the rear side of the conveyor belt 21, a guide member 29 is disposed corresponding to the image forming area of the recording head 7. This charging roller 26 is disposed to be in contact with the top layer of the conveyor belt 21 in order to be rotationarily driven to the rotation of the conveyor belt 21.

In addition, as illustrated in FIG. 2, a slit disk 34 is mounted onto the shaft of the conveyor roller 27. An encoder sensor 35 is provided to detect the slits of the slit disk 34. A rotary encoder 36 is constituted of the slit disk 34 and an encoder sensor 35.

Furthermore, as the sheet ejection unit to eject the sheet 12 on which the recording head 7 records an image, there are provided a separation claw 51 to separate the sheet 12 from the conveyor belt 21, a sheet ejection drive roller 52, a sheet ejection roller 53, and a sheet ejection tray 54 to store the ejected sheet 12.

A double-face sheet feeding unit is detachably mounted onto the rear side of the double-face sheet ejection unit. The double-face sheet feeding unit takes in and reverses the sheet 12 returned by the reverse rotation of the conveyor belt 21 and feeds the sheet 12 again between the counter roller 22 and the conveyor belt 21.

Furthermore, as illustrated in FIG. 2, a maintenance and recovery mechanism 56 is disposed in the non-image forming area on one side of the carriage 3 in the scanning direction thereof to maintain and recover the state of the nozzle of the recording head 7.

The maintenance and recovery mechanism 56 includes each cap 57 to cap each nozzle face of the recording head 7, a wiper blade 58 to wipe off the nozzle face, and a dummy discharging receiver 59 to receive liquid droplets discharged not for recording but for dummy discharging to discharge thickened ink.

In this image forming apparatus, the sheet 12 is separated and fed substantially vertically upward from the sheet feeding unit one by one, guided by the guide 15, and conveyed while being pinched between the conveyor belt 21 and the counter roller 22. Furthermore, in the image forming apparatus, the front end of the sheet 12 is guided by the conveyor guide 23 and pressed against the conveyor belt 21 by the pressing roller 25 to change the conveying direction substantially 90 degrees C.

At this time, a control unit applies an alternating bias to the charging roller 26 by an AC bias supplying unit to charge the conveyor belt 21 in a repeated pattern of plus and minus with a predetermined width in the sub-scanning direction as the circulation direction of the conveyor belt 21. When the sheet 12 is fed onto the conveyor belt 21 charged with this alternating pattern of plus and minus, the sheet 12 is adsorbed to the conveyor belt 21 and conveyed thereon in the sub-scanning direction by the circulation movement of the conveyor belt 21.

By driving the recording head 7 in response to image signals while moving the carriage 3 in the outward direction and return direction, ink droplets are discharged onto the sheet 12 standing still to record an image thereon for an amount corresponding to one line and thereafter the sheet 12 is conveyed in a predetermined amount for recording on the next line. On receiving a signal indicating that the recording is finished or the rear end of the sheet 12 has reached the image recording area, the recording operation stops and the sheet 12 is ejected to the sheet ejection tray 54.

In addition, in the case of double-face printing, the conveyor belt 21 is reversely rotated when the recording on the top surface (first printed surface) is complete. In this reverse rotation, the sheet 12 finished with recording is sent into the double-face sheet feeding unit 61, where the sheet 12 is reversed (to be ready for printing on the back surface) and fed between the counter roller 22 and the conveyor belt 21 again. Under timing control, the sheet 12 is conveyed to the conveyor belt 21 to record on the back surface and thereafter ejected to the sheet ejection tray 54.

The carriage 3 is moved toward the maintenance and recovery mechanism 56 while standing by for printing (recording) and the recording head 7 is capped with the cap 57 to keep moisturizing the nozzle so that discharging failure ascribable to ink drying is prevented. In addition, the ink is suctioned from the nozzle with the recording head 7 capped with the cap 57 to discharge thickened ink and air bubbles for recovery. Due to this recovery operation, the ink attached to the nozzle surface of the recording head 7 is removed by wiping it off with the wiper blade 58. In addition, ink not correlating with recording is discharged before or during recording as dummy discharging. This makes it possible to maintain the discharging performance of the recording head 7 stable.

The recording head 7 includes luminous elements 161 and light receiving elements 162. Droplets of the ink are irradiated with light emitted from the luminous element 161 and the light receiving elements 162 receives the light to detect whether there is non-discharging nozzle and the position of the non-discharging nozzle.

Descriptions of known methods of detecting non-discharging nozzles are omitted in the present disclosure.

Figure 4:
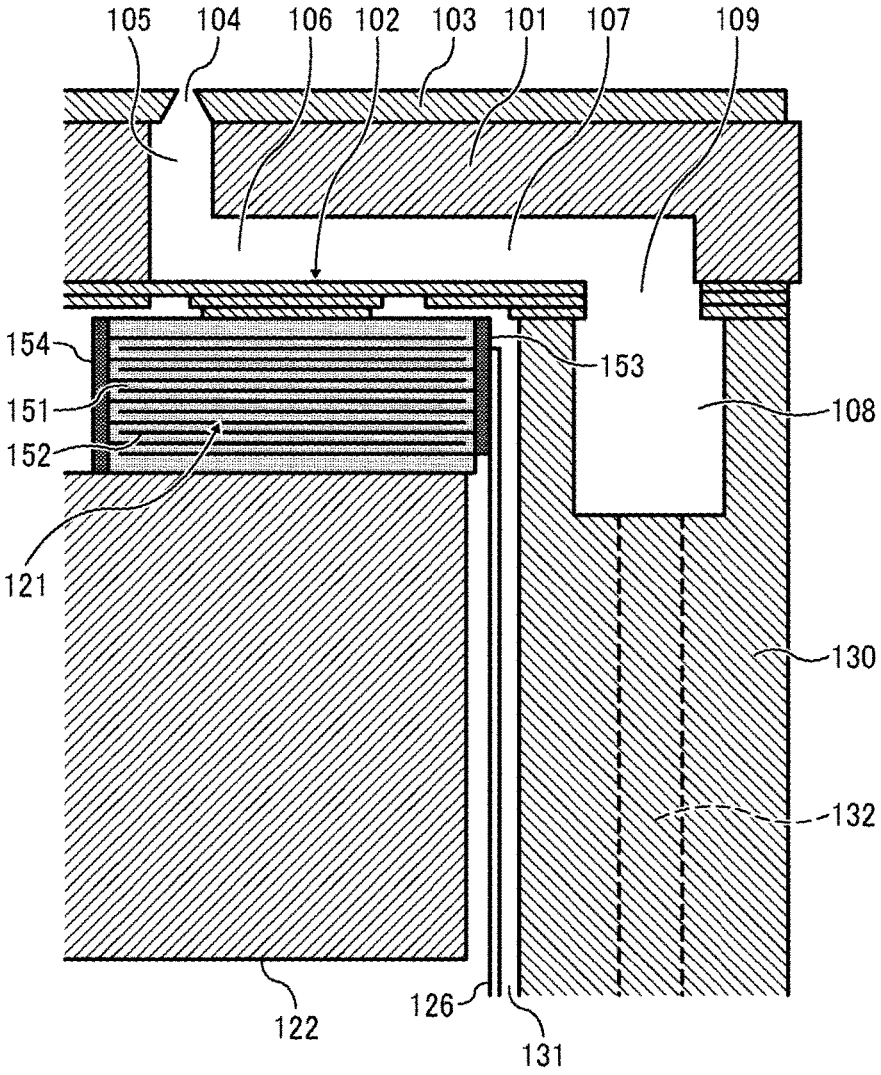
FIG. 4 is a diagram illustrating a cross section of the recording head of the image forming apparatus illustrated in FIG. 1 in the liquid chamber longitudinal direction.
Figure 5:
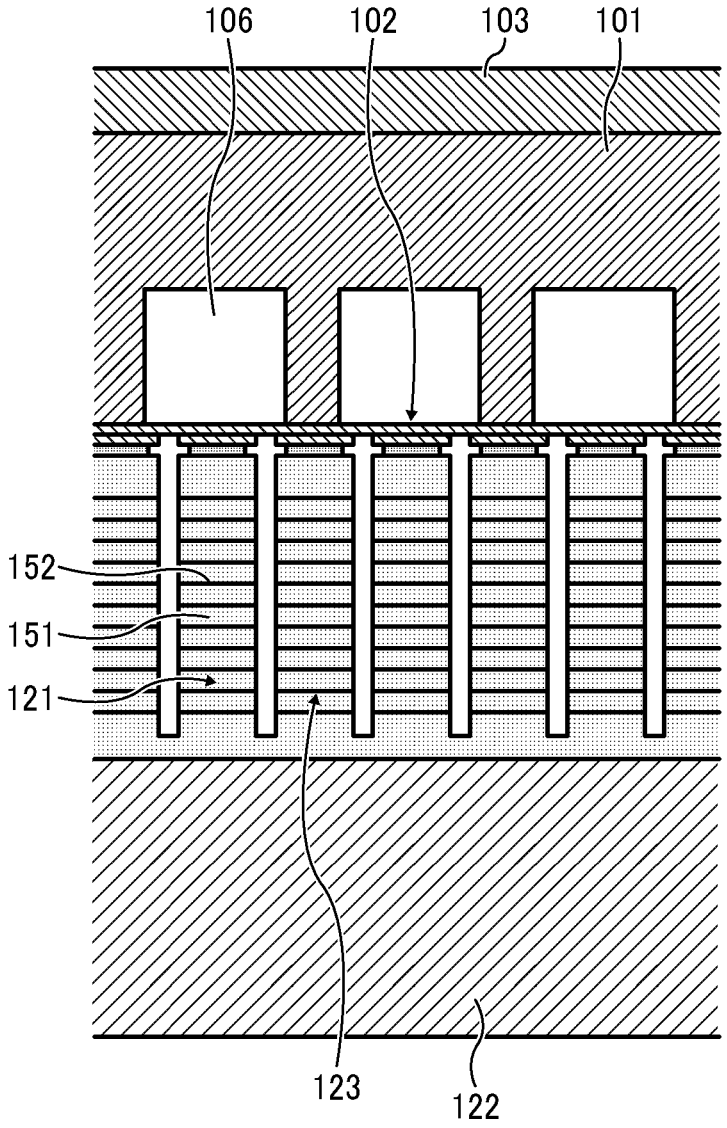
FIG. 5 is a diagram illustrating a cross section of the recording head of the image forming apparatus illustrated in FIG. 1 in the liquid chamber traverse direction (aligning with the arrangement of the nozzles)

Next, an embodiment of the liquid discharging head constituting the recording head 7 is described with reference to FIGS. 4 and 5. FIG. 4 is a diagram illustrating a cross section of the recording head in the liquid chamber longitudinal direction. FIG. 5 is a diagram illustrating a cross section of the recording head in the liquid chamber traverse direction (aligning with the arrangement of the nozzles).

This liquid discharging head includes a flow path plate 101, a diaphragm 102, a nozzle plate 103, a nozzle communicating path 105, a liquid chamber (also referred to as pressure chamber) 106, an ink supplying orifice 109, etc.

The flow path plate 101 is formed by, for example, aeolotropy-etching a single crystal silicon board. The diaphragm 102 formed by, for example, nickel electrocasting, is attached to the bottom surface of the flow path plate 101 and the nozzle plate 103 is laminated on the top surface of the flow path plate 101. A nozzle 104 to discharge liquid droplets (ink droplets) is communicated with the nozzle communicating path 105 serving as a flow path. A common liquid chamber 108 is disposed to supply ink to the liquid chamber 106 via a fluid resistance unit (supplying path) 107 while communicating with an ink supplying orifice 109.

In addition, the recording head 7 includes a piezoelectric element 121 of two-line lamination, which is an electromechanical transduction element serving as a pressure generating device (actuator) which deforms the diaphragm 102 to pressurize ink in the liquid chamber 106. Also, the recording head 7 includes a base board 122 to attach and fix the piezoelectric element 121.

Support pillars 123 are disposed between the piezoelectric elements 121. The support pillars 123 are simultaneously formed together with the piezoelectric elements 121 by separately processing piezoelectric element members. However, no drive voltage is applied to the support pillars 123, meaning, these are just pillars.

In addition, an FPC cable 126 carrying a drive circuit (integrated circuit) is connected with the piezoelectric element 121.

The periphery of the diaphragm 102 is attached to a frame member 130. The frame member 130 includes a through hole unit 131 to accommodate the actuator constituted of the piezoelectric element 121, the base board 122, etc., a concave portion serving as the common liquid chamber 108, and an ink supplying hole 132 to supply ink to the common liquid chamber 108 from outside. The frame member 130 is manufactured by injection molding with, for example, a thremocuring resin such as an epoxy-based resin or polyphenylene sulfite.

In the flow path plate 101, the concave portion and hole portions serving as the nozzle communicating path 105 and the liquid chamber 106 are formed by aeolotropy-etching, for example, a single crystal silicon board of crystal plane orientation (110) with an alkali etching liquid such as aqueous solution of potassium hydroxide. However, other than the single crystal silicon substrate, stainless board and photosensitive resins can be also used.

The diaphragm 102 is formed out of nickel metal plate and manufactured by, for example, an electroforming method. Also, metal plates and joint members of metal and resin plates may be used. The piezoelectric element 121 and the support pillars 123 are glued to the diaphragm 102 and the frame member 130 is also glued thereto.

On the nozzle plate 103, the nozzle 104 having a diameter of 10-30 μm is formed corresponding to each liquid chamber 106. The nozzle plate 103 is glued to the flow path plate 101. The nozzle plate 103 includes a repellent film formed on the uppermost surface of the nozzle forming member made of a metal member via a predetermined layer.

The piezoelectric member 121 is a laminar piezoelectric element (lead zirconate titanate: PZT in this case) in which piezoelectric materials 151 and internal electrodes 152 are alternately laminated. Each internal electrode 152 alternately pulled out to different end surfaces of the piezoelectric member 121 is connected with an individual electrode (also referred to as selective electrode) 153 and a common electrode 154.

In some embodiments, it is possible to have a configuration in which the ink in the liquid chamber 106 is pressurized utilizing displacement along a d33 direction as the piezoelectric direction of the piezoelectric member 121 or another configuration in which the ink in the liquid chamber 106 can be pressurized using displacement along a d31 direction as the piezoelectric direction of the piezoelectric member 121. In addition, a configuration in which a line of piezoelectric elements 121 are disposed on a single base board 122 is also suitable.

In the liquid discharging head having such a configuration, the piezoelectric element 121 contracts by, for example, lowering the voltage applied to the piezoelectric element 121 in comparison with a reference voltage. The diaphragm 102 is lowered, thereby inflating the volume of the liquid chamber 106 so that the ink flows into the liquid chamber 106. Thereafter, the voltage applied to the piezoelectric element 121 is raised to elongate the piezoelectric element 121 in the lamination direction, thereby deforming the diaphragm 102 toward the nozzle 104 direction so that the volume of the liquid chamber 106 shrinks to pressurize the ink in the liquid chamber 106. As a consequence, the ink droplet is discharged (jetted) from the nozzle 104.

Thereafter, the voltage applied to the piezoelectric element 121 is returned to the reference voltage. Accordingly, the diaphragm 102 is back to the initial position so that the liquid chamber 106 inflates, generating a negative pressure. At this time, the liquid chamber 106 is filled with the ink from the common liquid chamber 108.

After the vibration of the meniscus surface of the nozzle 104 decays and is stabilized, the system starts behaviors to discharge the next droplet.

The drive method of the head is not limited to the above-mentioned example (pull-push discharging). The way of discharging changes depending on how a drive waveform is applied.

Next, the control unit of this image forming apparatus is described with reference to the block diagram of FIG. 7.

Figure 6:
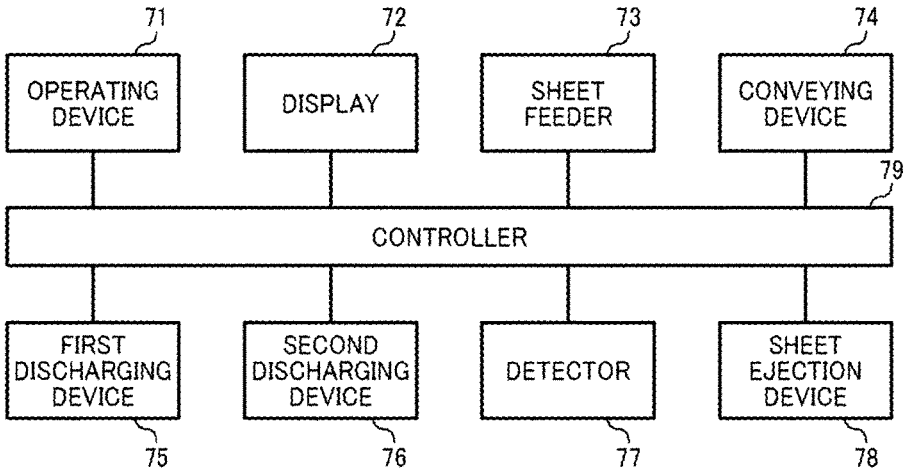
FIG. 6 is a functional block diagram of the image forming apparatus illustrated in FIG. 1.

FIG. 6 is a functional block diagram illustrating an example of the image forming apparatus illustrated in FIG. 1.

The image forming apparatus includes an operating device 71, a display 72, a sheet feeder 73, a conveyor 74, a first discharging device 75, a second discharging device 76, a detector 77, a sheet ejection device 78, and a controller 79. The operating device 71 includes a power switch, numeric keypads, a start key, a stop key, etc. on the operation panel required for a user to operate the image forming apparatus.

The display 72 includes members such as display elements and lamps on the operation panel required for a user to operate the image forming apparatus.

The sheet feeder 73 takes out the sheet 12 out of the sheet feeding cassette 10 and the sheet 12 is fed by the half-moon shape roller 13 and the separation pad 14 illustrated in FIG. 1. The conveyor 74 conveys the sheet 12 to the first discharging device 75 and the second discharging device 76 by various motors 2000 illustrated in FIG. 7.

The first discharging device 75 as the first recording head and the second discharging device 76 as the second recording head discharge ink as liquid droplets onto the sheet 12, which is conducted by the recording head 7 illustrated in FIG. 1.

The detector 77 detects a non-discharging nozzle of the first recording head and the second recording head, utilizing the luminous element 161 and the light receiving element 162 illustrated in FIG. 2. The sheet ejection device 78 ejects the printed sheet 12. The sheet 12 is ejected by the sheet ejection drive roller 52, the sheet ejection roller 53, the separation claw 51, and the sheet ejection tray 54 illustrated in FIG. 1. The controller 79 controls the image forming apparatus utilizing a central processing unit (CPU) 701, an image processing unit 810, a field-programmable gate array (FPGA) 702, a random access memory (RAM) 703, a read only memory (ROM) 704, and a non-volatile random access memory (NVRAM) 705.

Figure 7:
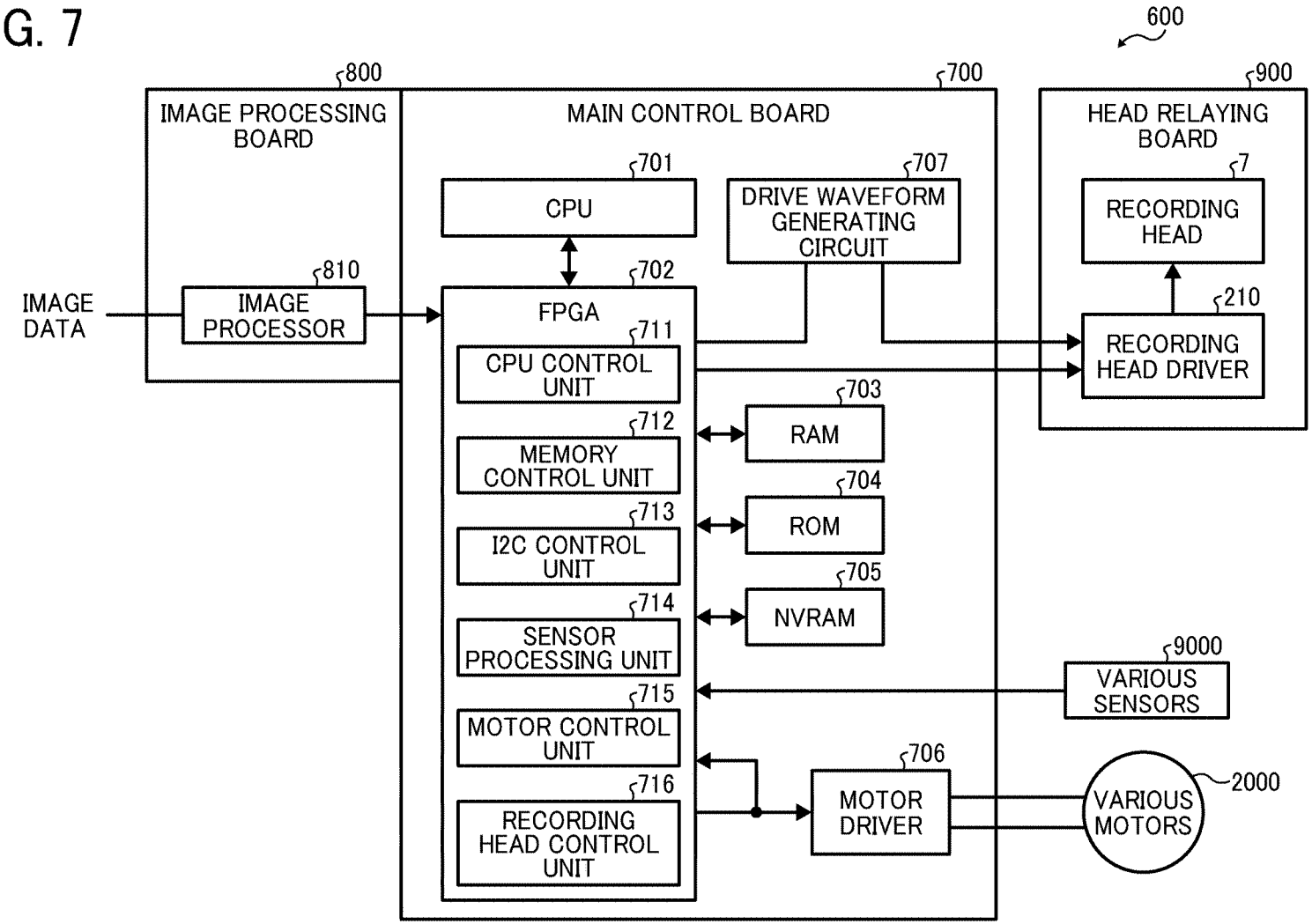
FIG. 7 is a block diagram illustrating an example of the hardware configuration of the image processing device according to an embodiment of the present disclosure.

FIG. 7 is a block diagram illustrating a hardware configuration of an image forming apparatus 600 according to some embodiments. The image forming apparatus 600 includes a main control board 700, a head relaying board 900, and an image processing board 800.

The main control board 700 includes the CPU 701, the FPGA 702, the RAM 703, the ROM 704, the NVRAM 705, a motor driver 706, a drive waveform generating circuit 707, etc.

The CPU 701 controls the entire of the image forming apparatus 600. For example, the CPU 701 utilizes the RAM 703 as the operation area, executes various control programs stored in the ROM 704, and outputs control instructions to control various operations in the image forming apparatus 600. The CPU 701 conducts operations and controls in the image forming apparatus 600 together with the FGPA 702 while communicating with the FPGA 702.

The FPGA 702 includes a CPU control unit 711, a memory control unit 712, an I2C control unit 713, a sensor processing unit 714, a motor control unit 715, and a recording head control unit 716.

The CPU control unit 711 has a function of communicating with the CPU 701. The memory control unit 712 has a function of making an access to the RAM 703 and the ROM 704. The I2C control unit 731 has a function of communicating with the NVRAM 705. The sensor processing unit 714 processes the sensor signals of various sensors 9000.

The various sensors 9000 is an inclusive term for the sensors to detect the states in the image forming apparatus 600. In addition to the encoder sensor 35 mentioned above, the various sensors 9000 include a sheet sensor to detect passing of the sheet 12, a cover sensor to detect whether the cover member is open, a temperature and humidity sensor to detect the environment temperature and humidity, a sensor for sheet fixing lever to detect the operation status of the lever to fix the sheet 12, a remaining amount detection sensor to detect the remaining amount of the ink in the cartridge.

Analogue sensor signals output from the temperature and humidity sensor are converted into digital signals by an AD converter mounted onto, for example, the main control board 700 and the digital signals are input into the FPGA 702.

The motor control unit 715 controls the various motors 2000. The various motors 2000 is an inclusive term for the motors included in the image forming apparatus 600. The various motor 2000 includes a main scanning motor to operate the carriage, a sub-scanning motor to convey the sheet 12 in the sub-scanning direction, a sheet feeding motor to feed the sheet 12, and a maintaining motor to operate the maintenance and recovery mechanism 56.

How the CPU 701 and the motor control unit 715 of the FPGA 702 cooperate for control is described taking the operation control of the main scanning motor 8 as an example.

First, the CPU 701 notifies the motor control unit 715 of the moving speed and the moving distance of the carriage 3 together with the operation starting instruction of the main scanning motor 8. The motor control unit 715 that has received this instruction creates a drive profile based on the information of the moving speed and the moving instruction notified of by the CPU 701, calculates a PWM instruction value while making a comparison with an encoder value (which is obtained by processing the sensor signal of the encoder sensor 35) supplied from the sensor processing unit 714, and outputs the PWM instruction value to the motor driver 706. The motor control unit 715 notifies the CPU 701 of the end of the operation when finished with a predetermined operation.

How the motor control unit 715 generates the drive profile is described in this example but it is possible to have a configuration in which the CPU 701 generates the drive profile and provides an instruction to the motor control unit 715. The CPU 701 also counts the number of prints and the number of scanning of the main scanning motor 8.

The recording head control unit 716 sends the head drive data, the discharging synchronization signal LINE, and the discharging timing signal CHANGE stored in the ROM 704 to the drive waveform generating circuit 707 to make the drive waveform generating circuit 707 generate the common drive waveform signal Vcom. The common drive waveform signal Vcom the drive waveform generating circuit 707 has generated is input into the recording head driver 210 described later implemented into the head relaying board 900.

Next, an embodiment of the print control unit 207 and the head driver 208 are described with reference to FIG. 8.

Figure 8:
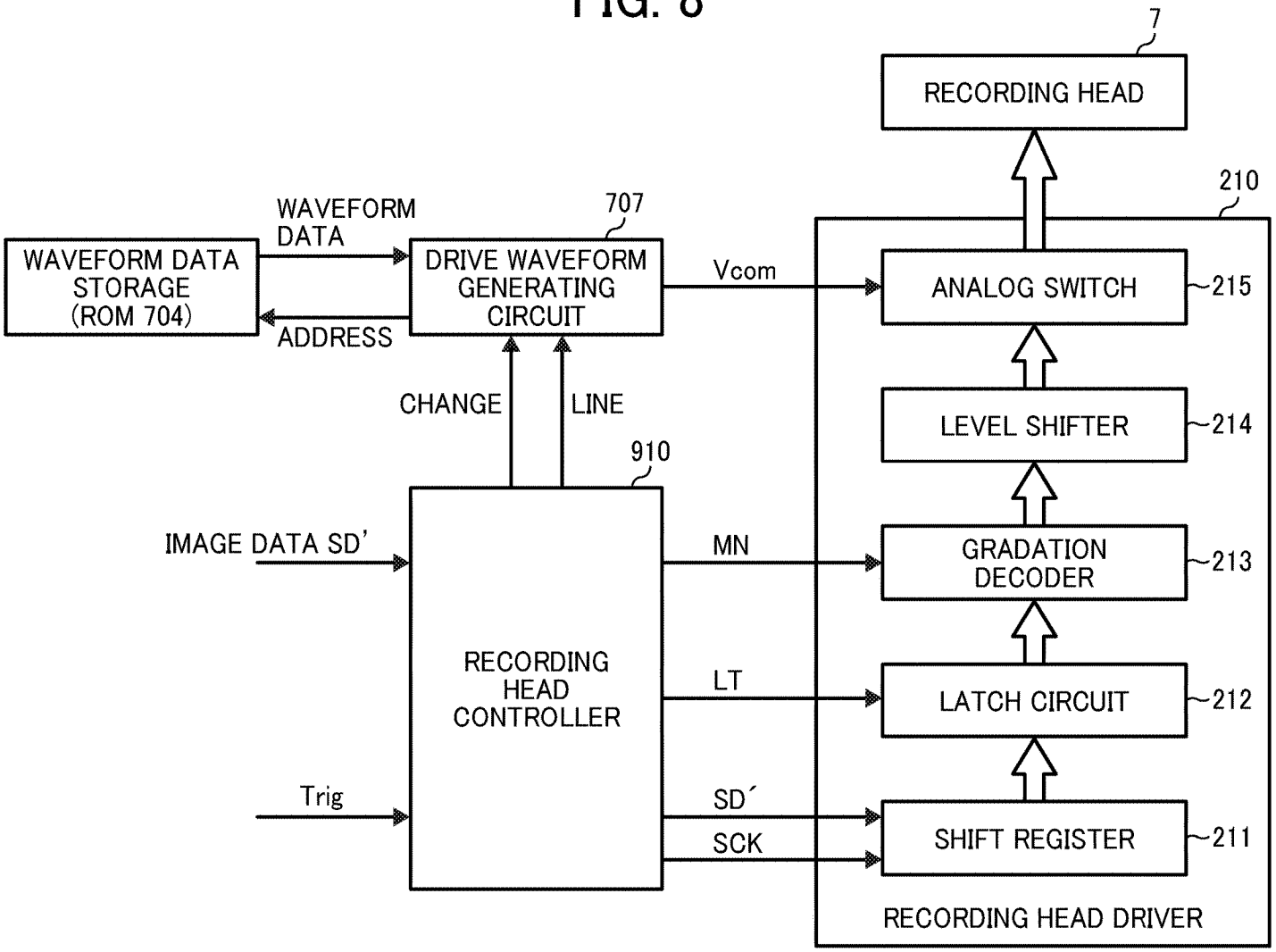
FIG. 8 is a block diagram illustrating a configuration of a recording head, a drive waveform generating circuit, and a recording head driver.

FIG. 8 is a block diagram illustrating a configuration of a recording head control unit 910, the drive waveform generating circuit 707, and the recording head driver 210.

When the recording head control unit 910 receives a trigger signal Trig as a trigger of the discharging, the recording head control unit 910 outputs the discharging synchronization signal LINE as the trigger of generating a drive waveform to the drive waveform generating circuit 707. Moreover, the discharging timing signal CHANGE corresponding to the delay amount from the discharging synchronization signal LINE is output to the drive waveform generating circuit 707 (FIG. 8).

The drive waveform generating circuit 707 generates the common drive waveform Vcom on the timing based on the discharging synchronization signal LINE and the discharging timing signal CHANGE.

Furthermore, the recording head control unit 910 receives image data SD' after image processing from the image processing unit 810 (which is described later) mounted on the image processing board 800. The recording head control unit 910 generates a mask control signal MN to select a predetermined waveform of the common drive waveform signal Vcom according to the size of an ink droplet to be discharged from each nozzle of the recording head 7 based on the image data SD'. The timing of the mask control signal MN is synchronized with the discharging timing signal CHANGE. The recording head control unit 910 transfers the image data SD', the synchronization clock signal SCK, a latch signal LT to provide a latch instruction of the image data, and the generated mask control signal MN to the recording head driver 210.

The recording head driver 210 includes a shift register 211, a latch circuit 212, a gradation decoder 213, a level shifter 214, and an analog switch 215 as illustrated in FIG. 8.

The image data SD' and the synchronization clock signal SCK transferred from the recording head control unit 910 are input into the shift register 211. The latch circuit 212 latches each value on the shift register 211 by the latch signal LT transferred from the recording head control unit 910.

The gradation decoder 213 decodes the value (the image data SD') latched at the latch circuit 212 and the mask control signal MN and outputs the outcome. The level shifter 214 level-converts the logic level voltage signal of the gradation decoder 213 to a level at which the analog switch 215 is operable.

The analog switch 215 opens and closes (on and off) depending on the output of the gradation decoder 213 provided via the level shifter 214. This analog switch 215 is disposed for each nozzle the recording head includes and connected with individual electrodes 153 of the piezoelectric element 121 corresponding to each nozzle. In addition, the common drive waveform signal Vcom from the drive waveform generating circuit 707 is input into the analog switch 215. Also, as described above, the timing of the mask control signal MN is synchronized with the timing of the common drive waveform Vcom. Therefore, if the on/off of the analog switch 215 is switched on a suitable timing according to the output of the gradation decoder 213 provided via the level shifter 214, the waveform to be applied to the piezoelectric element 70 corresponding to each nozzle is selected among the drive waveforms constituting the common drive waveform signal Vcom. As a consequence, the size of the ink droplet discharged from the nozzle is controlled.

The drive waveform generating circuit 707 generates and outputs a drive signal constituted of drive pulses P1 to P8 including waveform elements rising down from the reference voltage Ve and the waveform elements rising after the rising-down within a single print cycle (single drive cycle) as illustrated in FIG. 9.

Also, a drive pulse to be used is selected by the mask signal MN from the recording head control unit 910.

Due to the waveform element in which the voltage V of the drive pulse rises down from the reference voltage Ve, the piezoelectric element 121 contracts so that the volume of the liquid chamber 106 inflates. That is, this waveform element is a drawing-in waveform element. In addition, due to the waveform element in which the voltage rises after the rising-down, the piezoelectric element 121 elongates so that the volume of the liquid chamber 106 shrinks. That is, this waveform element is a pressurizing waveform element.

FIG. 10(A) is a diagram illustrating a small droplet selected from the drive waveforms, FIG. 10(B) is a diagram illustrating a middle-sized droplet selected from the drive waveforms. FIG. 10(C) is a diagram illustrating a large droplet selected from the drive waveforms and FIG. 10(D) is a diagram illustrating a fine drive selected from the drive waveform.

When a small droplet (small dot) is formed according to the mask control signal MN from the recording head control unit 910, the drive pulse P1 is selected as illustrated in FIG. 10(A). When a middle-sized droplet (middle-sized dot) is formed, the drive pulses P4 to P6 are selected as illustrated in FIG. 10(B). When a large droplet (large dot) is formed, the drive pulses P2 to P8 are selected as illustrated in FIG. 10(C). In the case of the fine drive (vibrating meniscus with no droplet discharging), the fine drive pulse P2 is selected to be applied to the piezoelectric element 121 of the recording head 7 as illustrated in FIG. 10(D).

At the time of forming a middle-sized droplet, the drive pulse P4 is applied to discharge the first droplet, the drive pulse P5 is applied to discharge the second droplet, and the drive pulse P6 is applied to discharge the third droplet. These three droplets are unified as a single droplet in the air. At this time, when the characteristic vibration cycle of the liquid chamber 106 is set as Tc, the interval between the discharging timing of the drive pulses P4 and P5 is preferably 2Tc−0.5 μs to 2Tc+0.5 μs.

Since the drive pulses P4 and P5 are constituted of simple drawing-discharging waveform elements, if the discharging pulse P6 is another drawing-discharging waveform element, the speed of the ink droplet excessively increases so that the landing position may deviates from the landing positions of other size droplets.

For this reason, as for the drive pulse P6, the drawing-in voltage is reduced (that is, making the rising-down voltage small) to decrease the degree of drawing in the meniscus, thereby suppressing the speed of the third ink droplet. However, to earn a required volume of ink droplets, the rising-down voltage is not reduced.

That is, the drawing-in waveform element of the last drive pulse of multiple drive pulses is relatively reduced so that the droplet discharging speed by the last drive pulse is relatively small. As a result, the landing position can be matched with the landing positions of the other sized droplets as much as possible.

In addition, the fine drive pulse P2 vibrates the meniscus of a nozzle with discharging no ink droplet to prevent drying of the meniscus of the nozzle. In the non-image area, this fine drive pulse P2 is applied to the recording head 7. In addition, the fine drive waveform (drive pulse P2) is utilized as one of the drive pulses for a large droplet to make the drive cycle shorter. That is, higher performance is achieved.

Furthermore, when the interval between the fine drive pulse P2 and the discharging pulse P3 is set within the range of Tc−0.5 μs to Tc+0.5 μs (Tc means characteristic vibration cycle), the volume of ink droplets discharged by the drive pulse P3 is earned. That is, the pressure vibration of the liquid chamber 106 by the vibration cycle generated by the fine drive pulse P2 is superimposed on the inflation of the liquid chamber 106 due to the drive pulse P3 so that the droplet volume can be larger than when only the drive pulse P3 is used.

Figure 11:
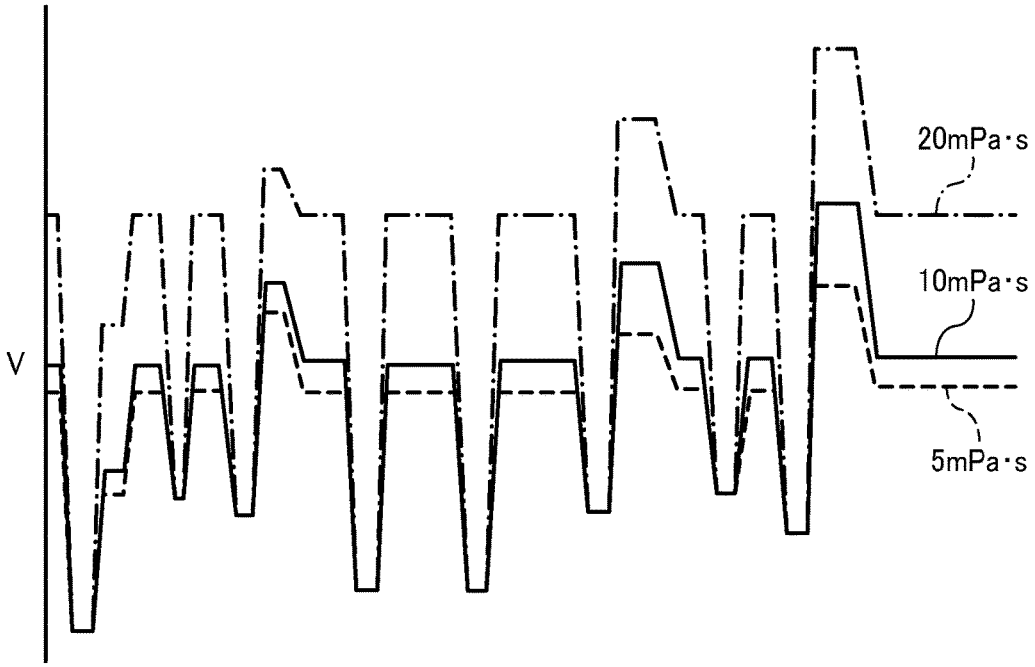
FIG. 11 is a diagram illustrating a drive waveform according to viscosity of ink.

The drive waveform required is different depending on the viscosity of ink. Taking this into account, the drive waveform at an ink viscosity of 5 mPa·s, the drive waveform at an ink viscosity of 10 mPa·s, and the drive waveform at an ink viscosity of 20 mPa·s are prepared in the image forming apparatus as illustrated in FIG. 11. The ink viscosity is determined based on the detected temperature detected by the temperature sensor to select the drive waveform for usage.

FIG. 11 is a diagram illustrating a drive waveform according to viscosity of ink.

That is, when the ink has a small viscosity, the voltage of the drive pulse is relatively low but when the ink has a large viscosity, the voltage of the drive pulse is relatively high. As a result, the discharging speed and the volume of ink droplets can be substantially the same irrespective of the ink viscosity (temperature). In addition, the drive pulse can vibrate meniscus without discharging an ink droplet by selecting the crest value according to the ink viscosity.

When using a drive waveform constituted of such drive pulses, the time until each of large, middle-sized, and small droplets lands on a sheet can be controlled. Therefore, it is possible to land each droplet at approximately the same position on the sheet even if the initiation time of discharging changes depending on the size of the droplet.

Figure 12:
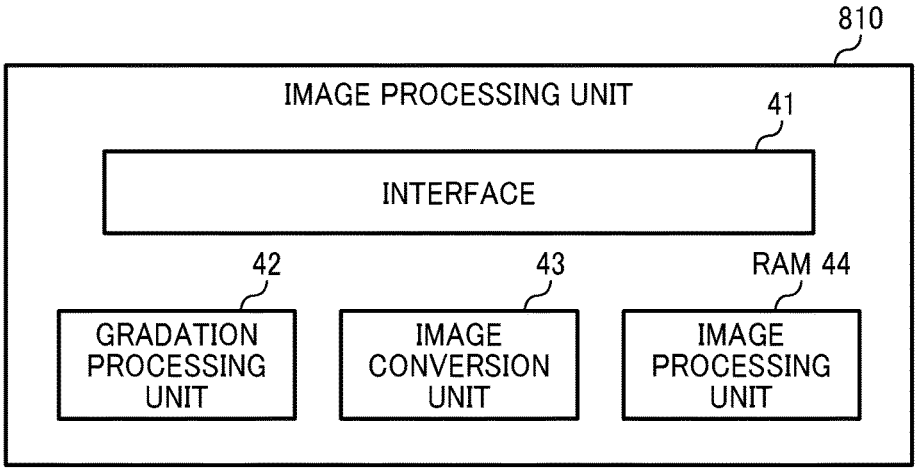
FIG. 12 is a block diagram illustrating an example of the configuration of the image processing unit illustrated in FIG. 7.

FIG. 12 is a functional block diagram illustrating an example of the configuration of the image processing unit 810.

The image processing unit 810 conducts gradation processing, image conversion processing for received image data to convert the received image data into an image data format the recording head control unit 716 can process. Thereafter, the image processing unit 810 outputs the image data after the conversion to the recording head control unit 716.

The image processing unit 810 includes an interface 41, a gradation processing unit 42, an image conversion unit 43, and an image processing unit RAM 44.

The interface 41 is an input unit of image data and serves as a communication interface between the CPU 701 and the FPGA 702. The gradation processing unit 42 conducts gradation processing for received multi-valued image data to convert small-number valued image data. The small-number valued image data includes the same graduation number equal to the kinds of droplets (large, middle-size, and small droplets) the recording head 7 discharges as illustrated in FIGS. 10A-D. The gradation processing unit 42 holds the converted image data on the image processing unit RAM 44 in an amount of one band or more.

The image data in an amount of one band corresponds to the maximum width in the sub-scanning direction the recording head 7 can record in a single scanning in the main scanning direction (moving direction of the carriage).

The image conversion unit 43 converts image data in an amount of one band on the image processing unit RAM 44 by the image unit output in a single scanning in the main scanning direction (moving direction of the carriage). This conversion is conducted to the configuration of the recording head 7, according to the information of the print sequence and print width (width of sub-scanning of image recording for each scanning) received from the CPU 701 via the interface 41.

The print sequence and the print width are selective for one pass printing in which an image is formed by a single main scanning for a recording medium or multiple pass printing in which an image is formed by multiple main scannings by the same or different nozzle groups for the same area of a recording medium. In addition, heads can be aligned in the main scanning direction to print on the same area with difference nozzles. These recording methods can be used in combination.

The print width represents the width in the sub-scanning direction (perpendicular direction to the moving direction of the carriage) of an image recorded in a single scanning in the main scanning direction (moving direction of the carriage) by the recording head 7. In some embodiments, the CPU 701 determines the print width.

The image conversion unit 43 outputs the converted image data SD' into the image recording unit 50 via the interface 41.

The function of the image processing unit 810 can be used as hardware for FPGA, ASIC, etc. and utilized for executing image processing programs stored in a memory inside the image processing unit 810.

Next, the image processing device in which the program relating to the present disclosure is stored to execute the image forming method of the present disclosure of outputting print images by the image forming apparatus mentioned above is described next.

Figure 13:
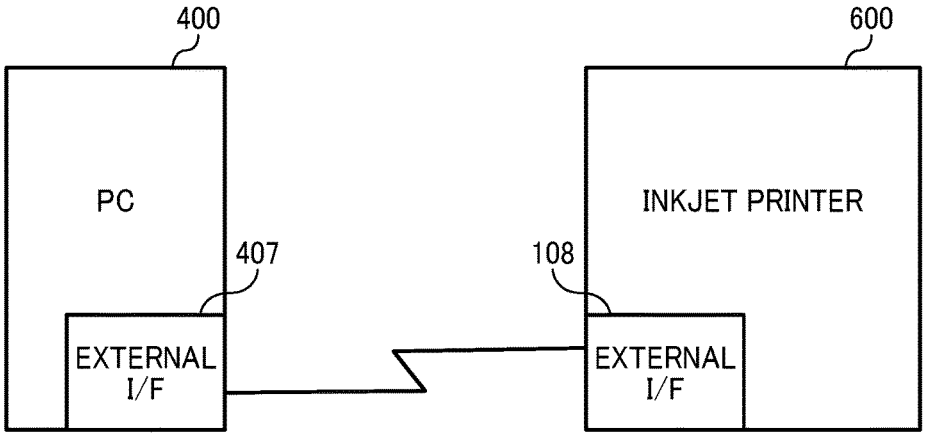
FIG. 13 is a block diagram illustrating an example of the image forming system according to an embodiment of the present disclosure.

FIG. 13 is a diagram illustrating an example of the image forming system having a configuration of the image processing device relating to the present disclosure and the inkjet printer (inkjet printing device) serving as the image forming apparatus mentioned above.

FIG. 13 is a block diagram illustrating an example of the image forming system relating to the present disclosure.

This print system (image forming system) includes one or more image processing device 400 constituted of home computers (PC), etc. and the image forming apparatus 600, both of which are connected with a predetermined interface or network.

Figure 14:
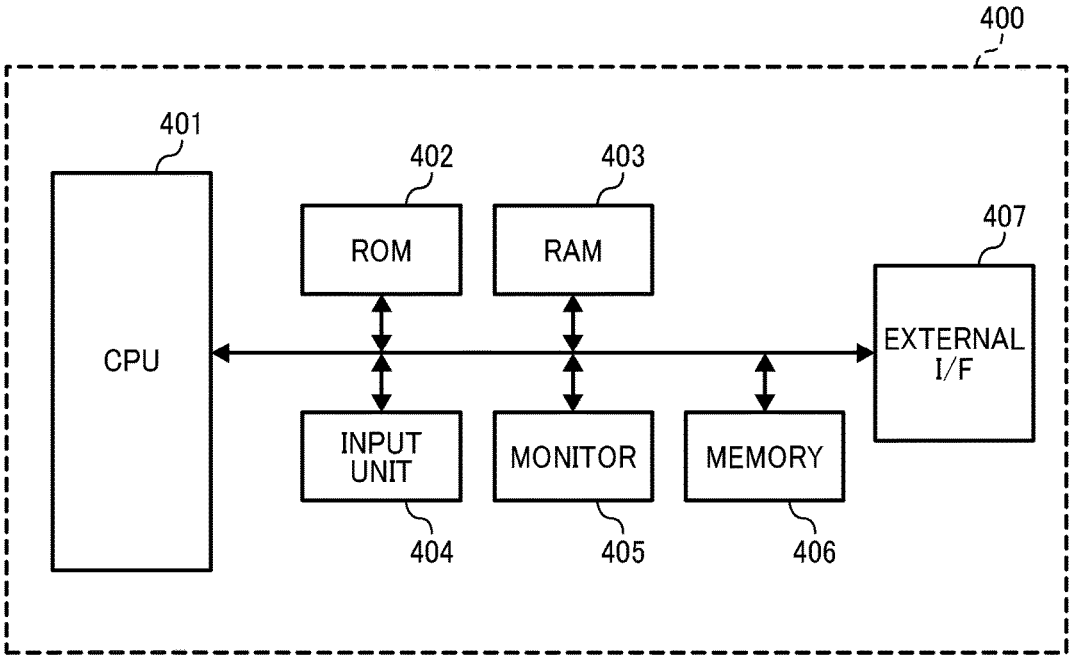
FIG. 14 is a block diagram illustrating an example of the image processing device in an image forming system according to an embodiment of the present disclosure.

In the image processing device 400, a CPU 401 is connected with various ROMs 402 and RAMs 403 serving as memory devices with bus lines as illustrated in FIG. 14. A storage device 406 using a magnetic storage device such as a hard disk drive (HDD), an input device 404 such as a mouse and a keyboard, a monitor 405 such as a liquid crystal display (LCD) and a cathode ray tube (CRT), and a storage medium reading device to read a storage medium such as an optical disc are connected with the bus line.

In addition, a predetermined interface (external I/F) 407 is connected to communicate with network such as the Internet and external devices such as universal serial bus (USB).

In the image processing device 400, image plotting and recording instructions of texts from applications or operating systems are temporarily stored in an image plotting data memory. The recording instruction includes, for example, positions, breadth, and shapes of lines to be recorded and fonts, sizes, and positions of texts to be recorded. This instruction is written in a particular print language.

The instruction stored in an image plotting data memory is interpreted by a rasterizer. In the case of an instruction of recording a line, the data is converted into recording dot patterns according to the determined position and breadth. In a case of an instruction to record texts, the outline information of the corresponding texts from font outline data stored in the image processing device 400 is read out and converted into recording dot patterns according to the determined position and size. In a case of an instruction of image data, the image data is converted into recording dot patterns as is.

These recording dot patterns are subject to image processing and stored in a raster data memory. At this time, the image processing device 400 rasterizes to the recording dot pattern data based on orthogonal grids as the basic recording position. The image processing includes, for example, color management module (CMM) to adjust colors, gamma correction processing, half-tone processing such as dithering methods and error diffusion methods, underlayer removing methods, and ink total volume control processing.

The recording dot pattern stored in the raster data memory is transferred to the inkjet recording device via the interface.

The storage device 406 of the image processing device 400 stores image processing programs. The image processing programs are installed into the storage device 406 from a storage medium by a storage medium reading device or by downloading through network such as the Internet.

Due to this installation, the image processing device 400 becomes operable to conduct the following image processing. This image processing program may be operable on a predetermined operating system (OS). Alternatively, it may constitute part of a particular application.

The image processing method can be executed by the image forming apparatus. In the following example, the inkjet recording device has no function of generating dot patterns to be actually recorded on the reception of an image plotting or text printing in the device.

That is, the print instruction from application software, etc. executed in the image processing device 400 serving as a host computer is image-processed by a printer driver installed into the image processing device 400 as a software. After the image processing, data (print image data) multi-valued dot patterns the inkjet printer can output is created for each color component, rasterized, and transferred to the inkjet printer, and thereafter the inkjet printer conduct printing.

Embodiment 1

Figure 15:
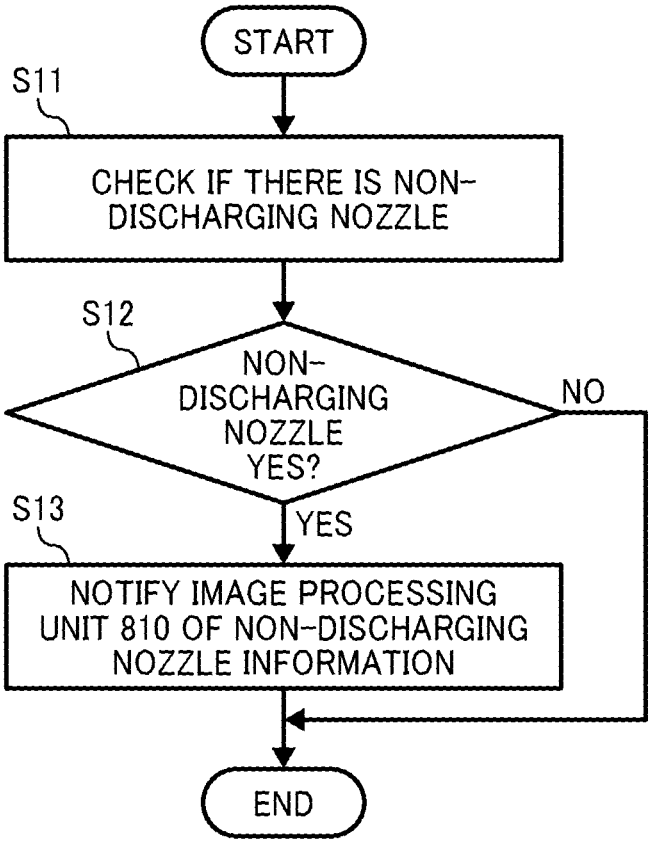
FIG. 15 is a flow chart illustrating an example of detecting a non-discharging nozzle.

FIG. 15 is a flow chart illustrating checking whether there is non-discharging nozzle conducted by the main control board 700 of the controller 79 of an inkjet printer.

First, in the detector 77 in the inkjet printer, whether there is a non-discharging nozzle for each color component is checked (Step S11). If there is no non-discharging nozzle, the process ends (step S12/No). If there is a non-discharging nozzle (Step S12/Yes), the main control board 700 notifies the image processing unit 810 of the information of the non-discharging (Step S13). The information of the non-discharging nozzle includes the position of the non-discharging nozzle.

Figure 16:
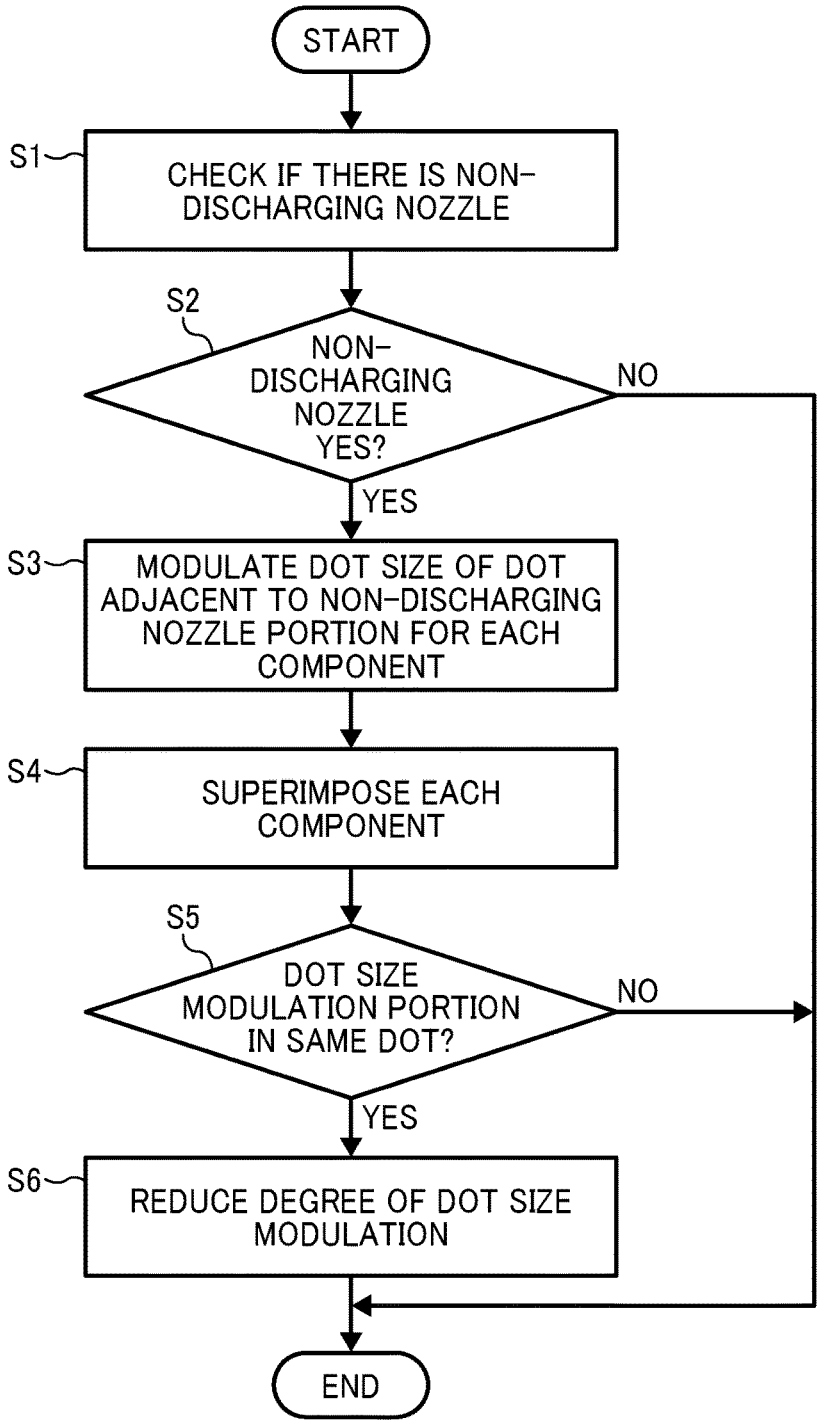
FIG. 16 is a flow chart illustrating an example of correcting a non-discharging nozzle.

FIG. 16 is a flow chart illustrating an example of the correction flow of non-discharging nozzle conducted by the image processing board 800 of the controller 79 of an inkjet printer.

The image processing device 810 converts the multi-valued image data input from the image processing device 400 into image data of the number of gradation the recording head 7 discharges and thereafter outputs to the FPGA 702 as the image data SD' suit to the configuration of the recording head 7. At this time, the correction flow is executed.

The image processing unit 810 stores the information of the non-discharging nozzle notified of by the inkjet printer in the image processing unit RAM 44.

When the correction flow starts, whether there is a non-discharging nozzle is checked based on the information stored in the image processing unit RAM 444 first (Step S1). If there is no non-discharging nozzle, the flow ends (step S2/No).

If there is a non-discharging nozzle (Step S2/Yes), the gradation processing unit 42 makes a correction of modulating the dot size of a dot adjacent to the dot corresponding to the non-discharging nozzle in the image of each color component converted by the image conversion unit 43. Since the image conversion unit 43 generates image data to the configuration of the recording head 7, it is possible to identify the dot corresponding to the non-discharging nozzle in the image conversion unit 43. The dot size modulation is deferred in detail. The modulation of the dot size is conducted for each color component (Step S3).

Next, the gradation processing unit 42 superimposes the image finished with dot size modulation for each color component (Step S4). As a result of the superimposition of the image for each color component, whether there is a dot size modulation site in the same (target) pixel (Step S5). If there is no dot size modulation site in the same pixel (Step S5/No), the process ends. If there is a dot size modulation site in the same pixel, the dot size modulation width is reduced to avoid excessive ink attachment (Step S5/Yes).

Embodiment 1 of the correction of the non-discharging nozzle is described below.

First, typical correction of a non-discharging nozzle is described with reference to FIGS. 17A, 17B, and 17C.

Figure 17A:
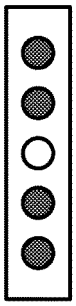
FIG. 17A is a schematic diagram illustrating a head.
Figure 17B:
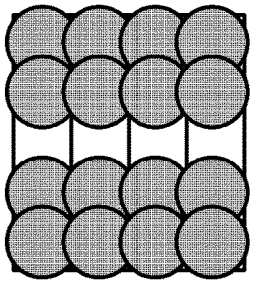
FIG. 17B is a schematic diagram illustrating dots with no correction of non-discharging nozzle.
Figure 17C:
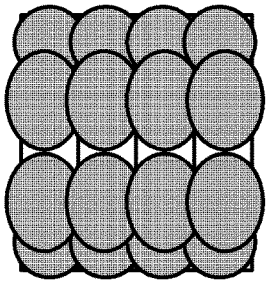
FIG. 17C is a schematic diagram illustrating dots with dot size modulation of adjacent dots.

FIG. 17A is a schematic diagram illustrating a head, FIG. 17B is a schematic diagram illustrating dots with no correction of non-discharging, and FIG. 17C is a schematic diagram illustrating dots with dot size modulation of adjacent dots.

When the central nozzle of the head is not dischargeable and no correction of non-discharging nozzle is conducted, a white streak appears since no dots are present on the central site. If the dot diameter of the adjacent dots to the dots of the non-discharging nozzle is modulated to a large size, visibility of the white streak ascribable to the non-discharging nozzle can be lowered.

Next, the non-discharging nozzle correction when printing a secondary color is described with reference to FIGS. 18A, 18B, and 18C and FIGS. 19A, 19B, and 19C.

Figure 18A:
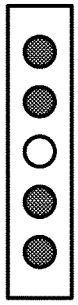
FIG. 18A is a schematic diagram illustrating a cyan head.
Figure 18B:
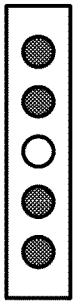
FIG. 18B is a schematic diagram illustrating a magenta head.
Figure 18C:
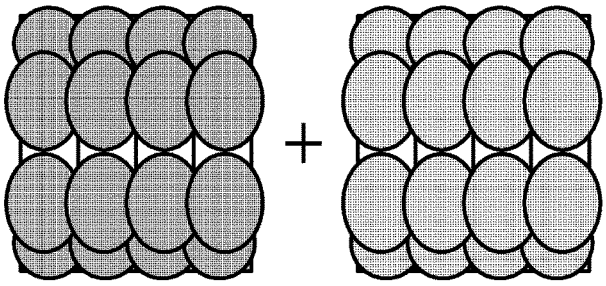
FIG. 18C is a schematic diagram illustrating dots at dot size modulation from the cyan head and the magenta head.
Figures 19A, 19B, 19C:
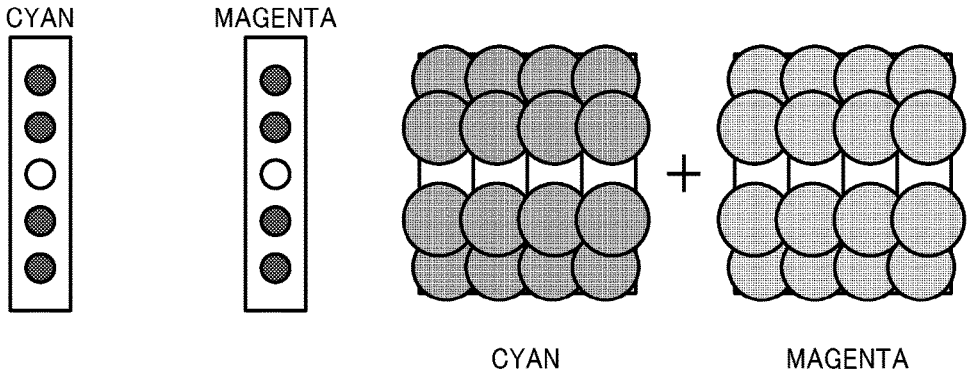
FIG. 19A is a schematic diagram illustrating a cyan head.
FIG. 19B is a schematic diagram illustrating a magenta head.
FIG. 19C is a schematic diagram illustrating dots at dot size modulation from the cyan head and the magenta head.

FIG. 18A is a schematic diagram illustrating a cyan head, FIG. 18B is a schematic diagram illustrating a magenta head, and FIG. 18C is a schematic diagram illustrating the dots with dot size modulation from the cyan head and the magenta head. FIG. 19A is a schematic diagram illustrating a cyan head, FIG. 19B is a schematic diagram illustrating a magenta head, and FIG. 19C is a schematic diagram illustrating dots with dot size modulation from the cyan head and the magenta head.

In this case, cyan and magenta are used.

FIGS. 18C and 19C are diagrams illustrating the case in which the central nozzles of the heads are non-dischargeable for both cyan and magenta.

In FIGS. 18A to 18C, the non-discharging nozzle correction is conducted for each color component in the same manner as illustrated in FIGS. 17A to 17C.

When printing cyan and magenta separately, visibility of a white streaks can be lowered by this non-discharging nozzle correction. However, when printing red by superimposition of cyan and magenta, the attachment amount of the ink onto the pixel is excessive due to the modulation of the dot size. If the amount surpasses the tolerable amount of the ink on a recording medium, drawbacks such as strike-through or transfer ascribable to shortage of drying occur.

Therefore, in the present disclosure, as illustrated in FIG. 19, if multiple colors are printed on the same pixel, the modulation of dot size is reduced to control the attachment amount of ink.

When cyan of FIG. 19A is singly printed, a white streak appears. However, when cyan and magenta are superimposed, the non-discharged site can be filled on the recording medium because of the amount corresponding to the two droplets. Therefore, visibility of the white streak lowers.

In this example, two colors are used. However, for example, if four color non-discharging occurs at the same pixel and the four colors are superimposed on the pixel, the modulation of the dot size is further reduced to control the attachment amount of the ink.

In addition, the modulation is reduced for both of the two colors but it is possible to make the modulation of only one of the two colors reduced unless the coloring is not affected.

Figures 20A, 20B, 20C:
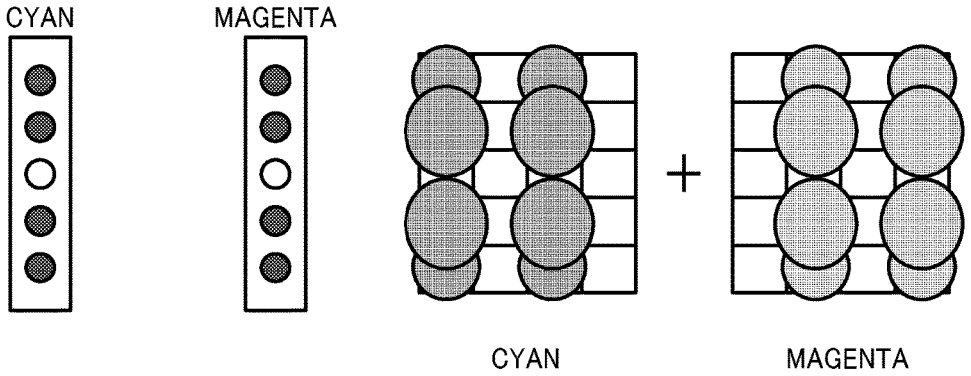
FIG. 20A is a schematic diagram illustrating a cyan head.
FIG. 20B is a schematic diagram illustrating a magenta head.
FIG. 20C is a schematic diagram illustrating dots at dot size modulation of adjacent dots.

FIG. 20A is a schematic diagram illustrating a cyan head, FIG. 20B is a schematic diagram illustrating a magenta head, and FIG. 20C is a schematic diagram illustrating dots with dot size modulation of adjacent dots.

In FIG. 20C, cyan and magenta are used to form an image but the landing positions of the two colors are not the same.

For example, since dots are scarce in a highlighted area, etc., occasionally, multiple colors are not discharged on the same pixel.

In such a case, the non-discharging nozzle can be effectively corrected by a combinational use of the processing illustrated in FIG. 19C and the processing illustrated in FIG. 20C.

Embodiment 2

In Embodiment 1 described above, the flow of correction relating to the present disclosure is executed by the image processing unit 810. Also, this correction can be executed by the image processing device 400.

In such a case, the image processing device 400 stores the information of the configuration of the recording head 7 and the information of the recording method such as the print sequence and the print width in a certain method. For example, the information of the configuration of the recording head 7 may be stored when the program is installed into the image processing device 400. Also, the recording method information may be stored on the timing when a user provides a print instruction.

The non-discharging nozzle information is transmitted from an inkjet printer to the image processing device 400 after the detection of the non-discharging nozzle.

In the embodiments described above, a serial type printer is employed where the recording head 7 carried by a carriage moves above a recording medium. Also, the embodiments are applicable to line printers where a recording medium moves below the fixed recording head 7.

According to the present disclosure, the amount of droplets discharged from a nozzle adjacent to a non-discharging nozzle of the first recording head and the amount of droplets discharged from a nozzle adjacent to a non-discharging nozzle of the second recording head are controlled. That is, nozzles in separate heads to land droplets on the same pixel site are detected as non-discharging nozzles and the amounts of the droplets from the nozzles adjacent to the non-discharging nozzle are controlled. As a consequence, visibility of white streaks due to non-discharging nozzle lowers and the amount of the ink attachment on a recording medium is controlled so that quality images can be formed.

The embodiments described above are just preferred embodiments and the present invention is not limited thereto. Various modifications can be made without departing from the scope of the present invention. For example, in the above-description, two recording heads are used for the correction but the present disclosure is not limited thereto. For example, three or more recording head can be used for the correction.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

The present invention can be implemented in any convenient form, for example using dedicated hardware, or a mixture of dedicated hardware and software. The present invention may be implemented as computer software implemented by one or more networked processing apparatuses. The processing apparatuses can compromise any suitably programmed apparatuses such as a general purpose computer, personal digital assistant, mobile telephone (such as a WAP or 3G-compliant phone) and so on. Since the present invention can be implemented as software, each and every aspect of the present invention thus encompasses computer software implementable on a programmable device. The computer software can be provided to the programmable device using any non-transitory recording medium. Examples of such recording medium for storing processor readable code include for storing processor readable code such as compact disc read only memories (CD-ROM), flexible disks (FD), and CD Recordables (CD-R), semiconductor memories such as flash memories, random access memories (RAM), read only memories (ROM), and ferroelectric RAMs (FeRAM), and hard disk drives (HDD).

What is claimed is:

1. An image forming apparatus comprising:

a first recording head including nozzles, each nozzle discharging a liquid droplet;

a second recording head including nozzles, each nozzle discharging a liquid droplet;

a detector configured to detect whether there is a non-discharging nozzle among the nozzles of the first recording head and the nozzles of the second recording head, the non-discharging nozzle being incapable of discharging the liquid droplet; and a controller to control at least one of an amount of a liquid droplet to be discharged from an adjacent nozzle adjacent to the non-discharging nozzle of the first recording head and an amount of a liquid droplet to be discharged from an adjacent nozzle adjacent to the non-discharging nozzle of the second recording head when a target landing position of the liquid droplet of the non-discharging nozzle of the first recording head is the same as a target landing position of the liquid droplet of the non-discharging nozzle of the second recording head.

2. The image forming apparatus according to claim 1, wherein the controller checks a position of the non-discharging nozzle for each color component of an image to be formed and increases a dot size of the liquid droplet discharged from the adjacent nozzle of at least one of the first recording head and the adjacent nozzle of the second recording head.

3. The image forming apparatus according to claim 1, wherein the controller controls the amount of the liquid droplet to be discharged from the adjacent nozzle of the first recording head and the amount of the liquid droplet to be discharged from the adjacent nozzle of the second recording head only when multiple colors are superimposed on a same target pixel.

4. The image forming apparatus according to claim 1, wherein when the target landing position of the liquid droplet of the non-discharging nozzle of the first recording head is not the same as the target landing position of the liquid droplet of the non-discharging nozzle of the second recording head, the controller controls the adjacent nozzle of the first recording head and the adjacent nozzle of the second recording head to discharge a larger amount of the liquid droplet than when the target landing position of the liquid droplet of the non-discharging nozzle of the first recording head is the same as the target landing position of the liquid droplet of the non-discharging nozzle of the second recording head.

5. A method of forming an image by an image forming apparatus including a first recording head including nozzles and a second recording head including nozzles, the method comprising:

detecting whether there is a non-discharging nozzle among the nozzles of the first recording head and the nozzles of the second recording head, the non-discharging nozzle being capable of discharging the liquid droplet; and controlling at least one of an amount of a liquid droplet to be discharged from an adjacent nozzle adjacent to the non-discharging nozzle of the first recording head and an amount of a liquid droplet to be discharged from an adjacent nozzle adjacent to the non-discharging nozzle of the second recording head, when a target landing position of the liquid droplet of the non-discharging nozzle of the first recording head is the same as a target landing position of the liquid droplet of the non-discharging nozzle of the second recording head.

6. A non-transitory recording medium storing a plurality of instructions which, when executed by one or more processors, cause the processors to perform a method for controlling an image forming apparatus including a first recording head, a second recording head, a detector and a controller, comprising:

detecting whether there is a non-discharging nozzle among nozzles of the first recording head and nozzles of the second recording head the non-discharging nozzle being capable of discharging the liquid droplet; and controlling at least one of an amount of a liquid droplet to be discharged from an adjacent nozzle adjacent to the non-discharging nozzle of the first recording head and an amount of a liquid droplet to be discharged from an adjacent nozzle adjacent to the non-discharging nozzle of the second recording head, when a target landing position of the liquid droplet of the non-discharging nozzle of the first recording head is the same as a target landing position of the liquid droplet of the non-discharging nozzle of the second recording head.

* * * * *